US009169724B2

(12) United States Patent
Fripp et al.

(10) Patent No.: US 9,169,724 B2
(45) Date of Patent: Oct. 27, 2015

(54) EXPANDABLE CONICAL TUBING RUN THROUGH PRODUCTION TUBING AND INTO OPEN HOLE

(71) Applicant: Halliburton Energy Services, Inc., Houston, TX (US)

(72) Inventors: Michael Fripp, Carrollton, TX (US); John Gano, Carrollton, TX (US); Peter Besselink, Enschede (NL); Wilfried Van Moorleghem, Herk (BE)

(73) Assignee: Halliburton Energy Services, Inc., Houston, TX (US)

( * ) Notice: Subject to any disclaimer, the term of this patent is extended or adjusted under 35 U.S.C. 154(b) by 441 days.

(21) Appl. No.: 13/673,024

(22) Filed: Nov. 9, 2012

(65) Prior Publication Data

US 2013/0220641 A1 Aug. 29, 2013

Related U.S. Application Data

(60) Provisional application No. 61/602,111, filed on Feb. 23, 2012.

(51) Int. Cl.
*E21B 33/13* (2006.01)
*E21B 43/12* (2006.01)
(Continued)

(52) U.S. Cl.
CPC ..... *E21B 43/12* (2013.01); *E21B 33/124* (2013.01); *E21B 33/1208* (2013.01);
(Continued)

(58) Field of Classification Search
CPC ..... E21B 43/103; E21B 43/106; E21B 33/10; E21B 33/124; E21B 34/06; E21B 43/12; E21B 33/13; E21B 33/1208; E21B 43/08; E21B 43/105; E21B 29/10; E21B 43/108
USPC ..... 166/387, 206, 207, 386, 380, 381, 384, 166/217
See application file for complete search history.

(56) References Cited

U.S. PATENT DOCUMENTS 1,301,285 A 4/1919 Leonard
1,476,830 A * 12/1923 Newell ..... 138/120
(Continued)

FOREIGN PATENT DOCUMENTS

EP 1223305 A2 7/2002
EP 1717411 A1 11/2006
(Continued)

OTHER PUBLICATIONS

International Search Report and Written Opinion for PCT/UC2013/023720 dated May 15, 2013.
(Continued)

*Primary Examiner* — Daniel P Stephenson
(74) *Attorney, Agent, or Firm* — McDermott Will & Emery LLP; Scott Richardson

(57) ABSTRACT

A downhole completion assembly for sealing and supporting an open hole section of a wellbore includes a first sealing structure having opposing first and second ends and being arranged within an open hole section of a wellbore, the first sealing structure being movable between a contracted configuration and an expanded configuration. A second sealing structure has opposing first and second ends and is arranged proximate the first sealing structure within the wellbore, the second sealing structure also being movable between a contracted configuration and an expanded configuration. When in their respective expanded configurations, the first and second sealing structures are frustoconical in shape and the first end of the second sealing structure is at least partially nested within the second end of the first sealing structure.

21 Claims, 5 Drawing Sheets

(51) Int. Cl.

| | |
|---|---|
| ***E21B 34/06*** | (2006.01) |
| ***E21B 43/10*** | (2006.01) |
| ***E21B 43/08*** | (2006.01) |
| ***E21B 33/12*** | (2006.01) |
| ***E21B 33/124*** | (2006.01) |

(52) U.S. Cl.

CPC ..... *E21B 33/13* (2013.01); *E21B 34/06* (2013.01); *E21B 43/08* (2013.01); *E21B 43/103* (2013.01); *E21B 43/106* (2013.01); *E21B 43/108* (2013.01)

(56) References Cited

U.S. PATENT DOCUMENTS

| | | | | |
|---|---|---|---|---|
| 3,203,451 | A | 8/1965 | Vincent | |
| 3,477,506 | A | 11/1969 | Malone | |
| 3,818,734 | A * | 6/1974 | Bateman | 72/75 |
| 4,484,625 | A | 11/1984 | Barbee, Jr. | |
| 5,343,949 | A | 9/1994 | Ross et al. | |
| 5,366,012 | A | 11/1994 | Lohbeck | |
| 5,597,042 | A | 1/1997 | Tubel et al. | |
| 5,609,178 | A | 3/1997 | Hennig et al. | |
| 5,635,675 | A * | 6/1997 | Houga | 174/68.3 |
| 5,738,146 | A | 4/1998 | Abe | |
| 6,142,230 | A | 11/2000 | Smalley et al. | |
| 6,253,850 | B1 | 7/2001 | Nazzai et al. | |
| 6,322,109 | B1 | 11/2001 | Campbell et al. | |
| 6,457,532 | B1 | 10/2002 | Simpson | |
| 6,457,533 | B1 | 10/2002 | Metcalfe | |
| 6,478,092 | B2 | 11/2002 | Voll et al. | |
| 6,695,054 | B2 | 2/2004 | Johnson et al. | |
| 6,695,067 | B2 | 2/2004 | Johnson et al. | |
| 6,719,064 | B2 | 4/2004 | Price-Smith et al. | |
| 6,725,918 | B2 | 4/2004 | Gano | |
| 6,725,934 | B2 | 4/2004 | Coronado et al. | |
| 6,782,953 | B2 * | 8/2004 | Maguire et al. | 166/380 |
| 6,834,725 | B2 | 12/2004 | Whanger et al. | |
| 6,854,522 | B2 | 2/2005 | Brezinski et al. | |
| 6,863,130 | B2 | 3/2005 | Steele et al. | |
| 6,920,935 | B2 | 7/2005 | Metcalfe | |
| 7,048,048 | B2 | 5/2006 | Nguyen et al. | |
| 7,124,821 | B2 * | 10/2006 | Metcalfe et al. | 166/277 |
| 7,124,830 | B2 | 10/2006 | Metcalfe | |
| 7,152,687 | B2 | 12/2006 | Gano | |
| 7,172,027 | B2 | 2/2007 | Simpson et al. | |
| 7,216,706 | B2 | 5/2007 | Echols et al. | |
| 7,252,142 | B2 | 8/2007 | Brezinski et al. | |
| 7,341,110 | B2 | 3/2008 | Doane et al. | |
| 7,404,437 | B2 | 7/2008 | Brezinski et al. | |
| 7,758,628 | B2 | 7/2010 | Besselink | |
| 7,777,644 | B2 | 8/2010 | Madhavan et al. | |
| 7,895,726 | B2 | 3/2011 | Maguire | |
| 8,230,913 | B2 | 7/2012 | Hart et al. | |
| 8,360,142 | B2 | 1/2013 | Durst et al. | |
| 8,776,876 | B2 | 7/2014 | Hart et al. | |
| 8,776,899 | B2 | 7/2014 | Fripp et al. | |
| 2002/0046840 | A1 | 4/2002 | Schetky et al. | |
| 2002/0092648 | A1 | 7/2002 | Johnson et al. | |
| 2002/0092658 | A1 | 7/2002 | Johnson et al. | |
| 2002/0125008 | A1 | 9/2002 | Wetzel et al. | |
| 2002/0162664 | A1 | 11/2002 | Bode et al. | |
| 2003/0047322 | A1 * | 3/2003 | Maguire et al. | 166/380 |
| 2003/0056948 | A1 | 3/2003 | Cameron | |
| 2003/0089496 | A1 | 5/2003 | Price-Smith et al. | |
| 2003/0183395 | A1 | 10/2003 | Jones | |
| 2003/0234111 | A1 | 12/2003 | Echols et al. | |
| 2004/0060695 | A1 | 4/2004 | Castano-Mears et al. | |
| 2004/0074642 | A1 | 4/2004 | Price-Smith et al. | |
| 2004/0168799 | A1 | 9/2004 | Simonds et al. | |
| 2004/0251033 | A1 | 12/2004 | Cameron et al. | |
| 2005/0077052 | A1 | 4/2005 | Ohmer | |
| 2005/0279514 | A1 | 12/2005 | Metcalfe | |
| 2006/0037745 | A1 | 2/2006 | Hart et al. | |
| 2006/0054330 | A1 | 3/2006 | Ring et al. | |
| 2007/0029082 | A1 | 2/2007 | Giroux et al. | |
| 2007/0034386 | A1 | 2/2007 | Henry | |
| 2007/0084637 | A1 | 4/2007 | Orban et al. | |
| 2007/0095532 | A1 | 5/2007 | Head et al. | |
| 2007/0267201 | A1 | 11/2007 | Brezinski et al. | |
| 2008/0149349 | A1 | 6/2008 | Hiron et al. | |
| 2008/0230234 | A9 | 9/2008 | Gano et al. | |
| 2009/0151957 | A1 * | 6/2009 | Sickle et al. | 166/373 |
| 2009/0205843 | A1 | 8/2009 | Gandikota et al. | |
| 2009/0301733 | A1 | 12/2009 | Shuster et al. | |
| 2010/0071911 | A1 | 3/2010 | Carree | |
| 2010/0122820 | A1 | 5/2010 | Holland | |
| 2010/0243277 | A1 | 9/2010 | Ring | |
| 2010/0314130 | A1 * | 12/2010 | Durst et al. | 166/382 |
| 2011/0214855 | A1 | 9/2011 | Hart et al. | |
| 2011/0247813 | A1 | 10/2011 | Moen | |
| 2013/0056228 | A1 | 3/2013 | Gruetzmann et al. | |
| 2013/0220640 | A1 | 8/2013 | Fripp et al. | |
| 2013/0220642 | A1 | 8/2013 | Fripp et al. | |
| 2013/0220643 | A1 | 8/2013 | Fripp et al. | |
| 2013/0220644 | A1 | 8/2013 | Fripp et al. | |
| 2014/0090857 | A1 | 4/2014 | Fripp et al. | |
| 2014/0196914 | A1 | 7/2014 | Ring et al. | |
| 2015/0075816 | A1 * | 3/2015 | Jacob | 166/387 |

FOREIGN PATENT DOCUMENTS

| | | | |
|---|---|---|---|
| GB | 2 345 308 | A | 7/2000 |
| GB | 2371064 | A | 7/2002 |
| GB | 2401131 | A | 11/2004 |
| WO | 2005003511 | A1 | 1/2005 |
| WO | 2013126190 | A1 | 8/2013 |
| WO | 2013126191 | A1 | 8/2013 |
| WO | 2013126192 | A1 | 8/2013 |
| WO | 2013126193 | A1 | 8/2013 |
| WO | 2013126194 | A1 | 8/2013 |

OTHER PUBLICATIONS

International Search Report and Written Opinion for PCT/US2013/023709 dated May 30, 2013.

International Search Report and Written Opinion for PCT/US2013/023733 dated Jun. 26, 2013.

International Search Report and Written Opinion for PCT/US2013/023736 dated May 14, 2013.

Official Action for European Patent Application No. 13751125.9 dated Jul. 20, 2015.

* cited by examiner

EXPANDABLE CONICAL TUBING RUN THROUGH PRODUCTION TUBING AND INTO OPEN HOLE

CROSS-REFERENCE TO RELATED APPLICATIONS

This present application claims priority to U.S. Provisional Patent App. No. 61/602,111 entitled "Extreme Expandable Packer and Downhole Construction," and filed on Feb. 23, 2012, the contents of which are hereby incorporated by reference in their entirety.

BACKGROUND

This present invention relates to wellbore completion operations and, more particularly, to a downhole completion assembly for sealing and supporting an open hole section of a wellbore.

Oil and gas wells are drilled into the Earth's crust and extend through various subterranean zones before reaching producing oil and/or gas zones of interest. Some of these subterranean zones may contain water and it is often advantageous to prevent the subsurface water from being produced to the surface with the oil/gas. In some cases, it may be desirable to block gas production in an oil zone, or block oil production in a gas zone. Where multiple oil/gas zones are penetrated by the same borehole, it is sometimes required to isolate the several zones, thereby allowing separate and intelligent production control from each zone for most efficient production. In traditionally completed wells, where a casing string is cemented into the wellbore, external packers are commonly used to provide annular seals or barriers between the casing string and the centrally-located production tubing in order to isolate the various zones.

It is increasingly common, however, to employ completion systems in open hole sections of oil and gas wells. In these wells, the casing string is cemented only in the upper portions of the wellbore while the remaining portions of the wellbore remain uncased and generally open (i.e., "open hole") to the surrounding subterranean formations and zones. Open hole completions are particularly useful in slanted wellbores that have borehole portions that are deviated and run horizontally for thousands of feet through producing and non-producing zones. Some of the zones traversed by the slanted wellbore may be water zones which must be generally isolated from any hydrocarbon-producing zones. Moreover, the various hydrocarbon-producing zones often exhibit different natural pressures and must be intelligently isolated from each other to prevent flow between adjacent zones and to allow efficient production from the low pressure zones.

In open hole completions, annular isolators are often employed along the length of the open wellbore to allow selective production from, or isolation of, the various portions of the producing zones. As a result, the formations penetrated by the wellbore can be intelligently produced, but the wellbore may still be susceptible to collapse or unwanted sand production. To prevent the collapse of the wellbore and sand production, various steps can be undertaken, such as installing gravel packs and/or sand screens. More modern techniques include the use of expandable tubing in conjunction with sand screens. These types of tubular elements may be run into uncased boreholes and expanded once they are in position using, for example, a hydraulic inflation tool, or by pulling or pushing an expansion cone through the tubular members.

In some applications, the expanded tubular elements provide mechanical support to the uncased wellbore, thereby helping to prevent collapse. In other applications, contact between the tubular element and the borehole wall may serve to restrict or prevent annular flow of fluids outside the production tubing. However, in many cases, due to irregularities in the borehole wall or simply unconsolidated formations, expanded tubing and screens will not prevent annular flow in the borehole. For this reason, annular isolators, such as casing packers, are typically needed to stop annular flow. Use of conventional external casing packers for such open hole completions, however, presents a number of problems. They are significantly less reliable than internal casing packers, they may require an additional trip to set a plug for cement diversion into the packer, and they are generally not compatible with expandable completion screens.

Efforts have been made to form annular isolators in open hole completions by placing a rubber sleeve on expandable tubing and screens and then expanding the tubing to press the rubber sleeve into contact with the borehole wall. These efforts have had limited success due primarily to the variable and unknown actual borehole shape and diameter. Moreover, the thickness of the rubber sleeve must be limited since it adds to the overall tubing diameter, which must be small enough to extend through small diameters as it is run into the borehole. The maximum size is also limited to allow the tubing to be expanded in a nominal or even undersized borehole. On the other hand, in washed out or oversized boreholes, normal tubing expansion is not likely to expand the rubber sleeve enough to contact the borehole wall and thereby form a seal. To form an annular seal or isolator in variable sized boreholes, adjustable or variable expansion tools have been used with some success. Nevertheless, it is difficult to achieve significant stress in the rubber with such variable tools and this type of expansion produces an inner surface of the tubing which follows the shape of the borehole and is not of substantially constant diameter.

SUMMARY OF THE INVENTION

This present invention relates to wellbore completion operations and, more particularly, to a downhole completion assembly for sealing and supporting an open hole section of a wellbore.

In some embodiments, a downhole completion system is disclosed. The system may include a first sealing structure having opposing first and second ends, the first sealing structure being movable between a contracted configuration and an expanded configuration, and a second sealing structure having opposing first and second ends and being arranged proximate the first sealing structure, the second sealing structure also being movable between a contracted configuration and an expanded configuration, wherein, when in their respective expanded configurations, the first and second sealing structures are frustoconical in shape and the first end of the second sealing structure is at least partially nested within the second end of the first sealing structure.

In other embodiments, methods of completing an open hole section of a wellbore is disclosed. One method may include conveying a first sealing structure having opposing first and second ends to the open hole section and radially expanding the first sealing structure, and conveying a second sealing structure having opposing first and second ends to the open hole section and radially expanding the second sealing structure, wherein, when expanded, the first and second sealing structures are frustoconical in shape and the first end of the second sealing structure is at least partially nested within the second end of the first sealing structure.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This present invention relates to wellbore completion operations and, more particularly, to a downhole completion assembly for sealing and supporting an open hole section of a wellbore.

The present invention provides a downhole completion system that features frustoconically-shaped expandable sealing structures that expand such that subsequent sealing structures are at least partially nested within a preceding sealing structure. Some sealing structures may include a corresponding internal truss structure expandable therein. In operation, the expanded sealing structure may be useful in sealing the inner radial surface of the open borehole, thereby preventing the influx of unwanted fluids, such as water. The internal truss structure may be arranged within the sealing structure and useful in supporting the expanded sealing structure and otherwise providing collapse resistance to the corresponding open hole section of the wellbore. The downhole completion system may include multiple sealing and internal truss structures deployed downhole in adjacent locations.

Axially adjacent sealing structures may be sealingly coupled using one or more sealing elements. In some embodiments, the sealing elements may provide fluid communication between the surrounding subterranean formation and the interior of the completion system. In at least one embodiment, one or more flow control devices may be disposed within corresponding conduits formed in the sealing elements. In operation, flow control devices, and optional filter devices, may provide a planned flow path for the intelligent production of hydrocarbons from several micro-zones, thereby optimizing hydrocarbon production. The well production life can benefit from using short, isolated production or injection lengths with a combination of features such as isolation, filtration, flow control, collapse strength, and formation contact stress. All these features are achieved without removing the downhole completion system or requiring standard drilling or workover rig involvement. As a result, the life of a well may be extended, thereby increasing profits and reducing expenditures associated with the well. As will be apparent to those skilled in the art, the systems and methods disclosed herein may advantageously salvage or otherwise revive certain types of wells, such as watered-out wells, which were previously thought to be economically unviable.

Figure 1:
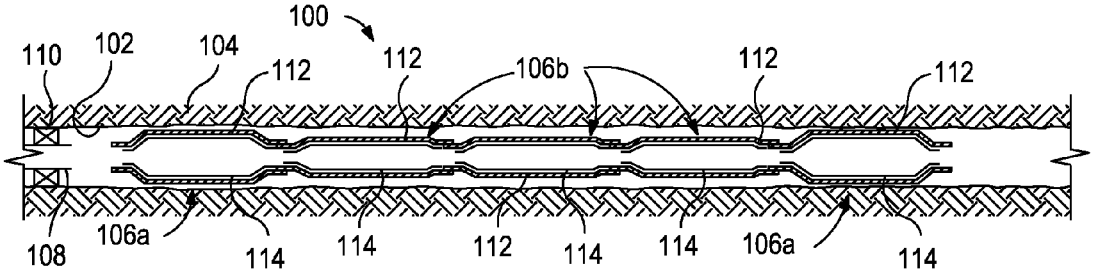
FIG. 1 illustrates an exemplary downhole completion system, according to one or more embodiments.

Referring to FIG. 1, illustrated is an exemplary downhole completion system 100, according to one or more embodiments disclosed. As illustrated, the system 100 may be configured to be arranged in an open hole section 102 of a wellbore 104. As used herein, the term or phrase "downhole completion system" should not be interpreted to refer solely to wellbore completion systems as classically defined or otherwise generally known in the art. Instead, the downhole completion system may also refer to or be characterized as a downhole fluid transport system. For instance, the downhole completion system 100, and the several variations described herein, may not necessarily be connected to any production tubing or the like. As a result, in some embodiments, fluids conveyed through the downhole completion system 100 may exit the system 100 into the open hole section 102 of the wellbore, without departing from the scope of the disclosure.

While FIG. 1 depicts the system 100 as being arranged in a portion of the wellbore 104 that is horizontally-oriented, it will be appreciated that the system 100 may equally be arranged in a vertical or slanted portion of the wellbore 104, or any other angular configuration therebetween, without departing from the scope of the disclosure. As illustrated, the downhole completion system 100 may include various interconnected sections or lengths extending axially within the wellbore 104. Specifically, the system 100 may include one or more end sections 106*a* (two shown) and one or more middle sections 106*b* (three shown) coupled to or otherwise generally interposing the end sections 106*a*. As will be described in more detail below, the end and middle sections 106*a,b* may be coupled together at their respective ends in order to provide an elongate conduit or structure within the open hole section 102 of the wellbore 104.

While only two end sections 106*a* and three middle sections 106*b* are depicted in FIG. 1, it will be appreciated that the system 100 can include any number of end and middle sections 106*a,b* without departing from the scope of the disclosure and depending on the particular application and downhole needs. Indeed, the system 100 can be progressively extended in either axial direction by adding various lengths thereto, such as additional end sections 106*a* and/or additional middle sections 106*b*, until a desired or predetermined length of the system 100 is achieved within the open hole section 102. Those skilled in the art will recognize that there is essentially no limit as to how long the system 100 may be extended to, being limited by the overall length of the wellbore 104, the size and amount of overlapping sections, finances, and/or time.

In some embodiments, the end sections 106*a* may be sized such that they are able to radially expand and seal against or otherwise clad the inner radial surface of the open hole section 102 when installed, thereby providing a corresponding isolation point along the axial length of the wellbore 104. As discussed below, one or more of the end sections 106*a* may include an elastomer or other sealing element disposed about its outer radial surface in order to sealingly engage the inner radial surface of the open hole section 102. The middle sections 106*b* may or may not be configured to seal against the inner radial surface of the open hole section 102. For example, in some embodiments, such as is illustrated in FIG. 1, one or more of the middle sections 106*b* may be characterized as "straddle" elements configured with a fixed outer diameter when fully expanded and not necessarily configured to seal against or otherwise engage the inner radial surface of the open hole section 102. Instead, such straddle elements may be useful in providing lengths of connective tubing or conduit for sealingly connecting the end sections 106*a* and providing fluid communication therethrough.

In other embodiments, one or more of the middle sections 106*b* may be characterized as "spanner" elements configured with a fixed outer diameter and intended to span a washout portion of the open hole section 102. In some embodiments, such spanner elements may exhibit variable sealing capabilities by having a sealing element (not shown) disposed about their respective outer radial surfaces. The sealing element may be configured to sealingly engage the inner radial surface of the open hole section 102 where washouts may be present. In yet other embodiments, one or more of the middle sections 106*b* may be characterized as "sealing" elements configured to, much like the end sections 106*a*, seal a portion of the wellbore 104 along the length of the open hole section 102. Such sealing elements may have an outer diameter that is matched (or closely matched) to a caliper log of the open hole section 102.

The downhole completion system 100 may be configured to pass through existing production tubing 108 extending within the wellbore 104 to reach the open hole section 102 of the wellbore 104. The production tubing 108 may be stabilized within the wellbore 104 with one or more annular packers 110 or the like. The production tubing 108 exhibits a reduced diameter, which requires the system 100 to exhibit an even more reduced diameter during run-in in order to effectively traverse the length of the production tubing 108 axially. For example, a 4.5 inch outer diameter production tubing 108 in a nominal 6.125 inch inner diameter open hole section 102 would require that the downhole completion system 100 would need to have a maximum diameter of 3.6 inches to pass through the nipples on the production tubing 102 and must be able to expand between 6-7.5 inches in the open hole section 102. Such ranges of diameters in the open hole section 102 is needed to account for potential irregularities in the open hole section 102. Moreover, in order to properly seal against the open hole section 102 upon proper deployment from the production tubing 108, the system 100 may be designed to exhibit a large amount of potential radial expansion upon deployment.

In some embodiments, each section 106*a,b* of the downhole completion system 100 may include at least one sealing structure 112 and at least one strength or truss structure 114. In other embodiments, the truss structure 114 may be omitted from one or more of the sections 106*a,b*, without departing from the scope of the disclosure. In some embodiments, the sealing structure 112 may be configured to be expanded and clad the inner radial surface of the open hole section 102, thereby providing a sealing function within the wellbore 104. In other embodiments, the sealing structure 112 may simply provide a generally sealed conduit or tubular for the system 100 to be connected to adjacent sections 106*a,b*.

As illustrated, at least one truss structure 114 may be generally arranged at least partially within a corresponding sealing structure 112 and may be configured to radially support the sealing structure 112 in its expanded configuration. The truss structure 114 may also be configured to or otherwise be useful in supporting the wellbore 104 itself, thereby preventing collapse of the wellbore 104. While only one truss structure 114 is depicted within a corresponding sealing structure 112, it will be appreciated that more than one strength or truss structure 114 may be used within a single sealing structure 112, without departing from the scope of the disclosure. Moreover, multiple truss structures 114 may be nested inside each other as there is adequate radial space in the expanded condition for multiple support structures 114.

Figure 2A:
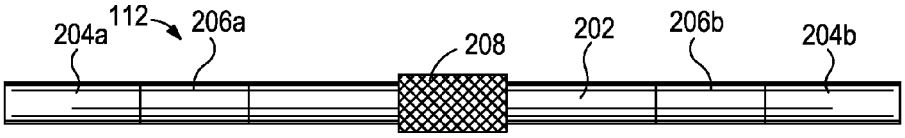
FIGS. 2A and 2B illustrate contracted and expanded sections of an exemplary sealing structure, according to one or more embodiments.
Figure 2B:
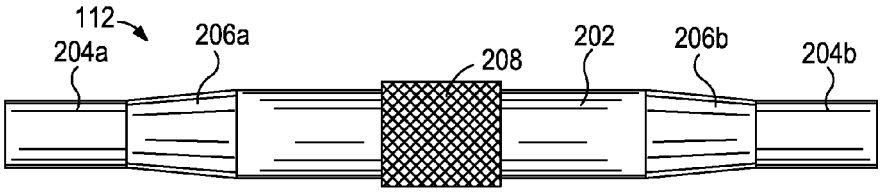

Referring now to FIGS. 2A and 2B, with continued reference to FIG. 1, illustrated is an exemplary sealing structure 112, according to one or more embodiments. Specifically, FIGS. 2A and 2B depict the sealing structure 112 in its contracted and expanded configurations, respectively. In its contracted configuration, as briefly noted above, the sealing structure 112 exhibits a diameter small enough to be run into the wellbore 104 through the reduced diameter of the production tubing 108. Once deployed from the production tubing 108, the sealing structure 112 is then able to be radially expanded into the expanded configuration.

In one or more embodiments, the sealing structure 112 may be an elongate tubular made of one or more metals or metal alloys. In other embodiments, the sealing structure 112 may be an elongate tubular made of thermoset plastics, thermoplastics, fiber reinforced composites, cementitious composites, combinations thereof, or the like. In embodiments where the sealing structure 112 is made of metal, the sealing structure 112 may be corrugated, crenulated, circular, looped, or spiraled. In embodiments where the sealing structure 112 is made from corrugated metal, the corrugated metal may be expanded to unfold the corrugations or folds defined therein. In embodiments where the sealing structure 112 is made of circular metal, stretching the circular tube will result in more strain in the metal but will advantageously result in increased strength.

As depicted in FIGS. 2A and 2B, the sealing structure 112 may be an elongate, corrugated tubular, having a plurality of longitudinally-extending corrugations or folds defined therein. Those skilled in the art, however, will readily appreciate the various alternative designs that the sealing structure 112 could exhibit, without departing from the scope of the disclosure. For example, as will be discussed in greater detail below, the sealing structure 112 may be an elongate tubular in the shape of a frustum or a generally frustoconical tubular.

As illustrated, the sealing structure 112 may include a sealing section 202, opposing connection sections 204*a* and 204*b*, and opposing transition sections 206*a* and 206*b*. The connection sections 204*a,b* may be defined at either end of the sealing structure 112 and the transition sections 206*a,b* may be configured to provide or otherwise define the axial transition from the corresponding connector sections 204*a,b* to the sealing section 202, and vice versa. In at least one embodiment, each of the sealing section 202, connection sections 204*a,b*, and transition sections 206*a,b* may be formed or otherwise manufactured differently so as to exhibit a different expansion potential (e.g., diameter) when the sealing structure 112 transitions into the expanded configuration. For instance, the corrugations (i.e., the peaks and valleys) of the sealing section 202 may exhibit a larger amplitude or frequency (e.g., shorter wavelength) than the corrugations of the connection sections 204*a,b*, thereby resulting in the sealing section 202 being able to expand to a greater diameter than the connection sections 204*a,b*. In the case of a frustoconically-shaped sealing structure 112, as described below, the wavelength of the corrugations along the axial length of the sealing section 112 may progressively become larger from one end of the sealing structure 112 to the other.

In some embodiments, the sealing structure 112 may further include a sealing element 208 disposed about at least a portion of the outer radial surface of the sealing section 202. In at least one embodiment, an additional layer of protective material may surround the outer radial circumference of the sealing element 208 to protect the sealing element 208 as it is advanced through the production tubing 108. The protective material may further provide additional support to the sealing structure 112 configured to hold the sealing structure 112 under a maximum running diameter prior to placement and expansion in the wellbore 104.

In operation, the sealing element 208 may be configured to expand as the sealing structure 112 expands and ultimately engage and seal against the inner diameter of the open hole section 102. In other embodiments, the sealing element 208 may provide lateral support for the downhole completion system 100 (FIG. 1). In some embodiments, the sealing element 208 may be arranged at two or more discrete locations along the length of the sealing section 202. In other embodiments, however, as discussed below, one or more sealing elements 208 may be arranged at each connection section 204*a,b* and, as a result, may be configured to seal against an axially adjacent sealing structure 112 upon expansion of the sealing structure 112.

The sealing element 208 may be made of an elastomer or a rubber, and may be swellable or non-swellable, depending on the application. In at least one embodiment, the sealing element 208 may be a swellable elastomer made from a mixture of a water swell and an oil swell elastomer. In other embodiments, the material for the sealing elements 208 may vary along the sealing section 202 or connection sections 204*a,b* in order to create the best sealing potential available for the fluid type that the particular seal element may be exposed to. One or more bands of sealing materials can be located as desired along the length of the sealing section 202. For instance, the sealing element 208 may include swellable elastomeric and/or bands of very viscous fluid. The very viscous liquid can be an uncured elastomer that will cure in the presence of well fluids. One example of such a very viscous liquid may include a silicone that cures with a small amount of water or other materials that are a combination of properties, such as a very viscous slurry of the silicone and small beads of ceramic or cured elastomeric material. It should be noted that to establish a seal the material of the seal element 208 does not need to change properties, but only have sufficient viscosity and length in the small radial space to remain in place for the life of the well. The presence of other fillers, such as fibers, can enhance the viscous seal.

Figure 3A:
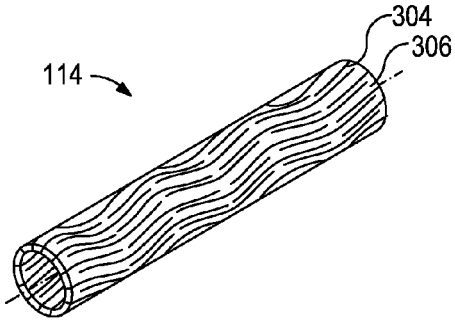
FIGS. 3A and 3B illustrate contracted and expanded sections of an exemplary truss structure, according to one or more embodiments.
Figure 3B:
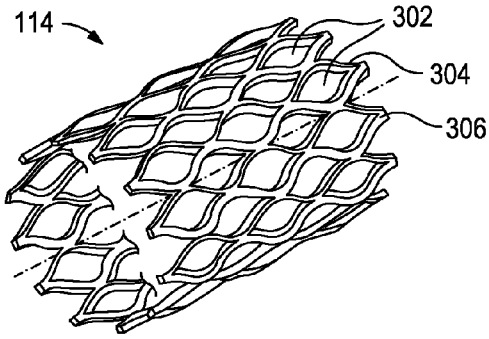

Referring now to FIGS. 3A and 3B, with continued reference to FIG. 1, illustrated is an exemplary strength or truss structure 114, according to one or more embodiments. Specifically, FIGS. 3A and 3B depict the truss structure 114 in its contracted and expanded configurations, respectively. In its contracted configuration, the truss structure 114 exhibits a diameter small enough to be able to be run into the wellbore 104 through the reduced diameter production tubing 108. In some embodiments, the truss structure 114 in its contracted configuration exhibits a diameter small enough to be nested inside the sealing structure 112 when the sealing structure 112 is in its contracted configuration and able run into the wellbore 104 simultaneously through the production tubing 108. Once deployed from the production tubing 108, the truss structure 114 is then able to radially expand into its expanded configuration.

In some embodiments, the truss structure 114 may be an expandable device that defines or otherwise utilizes a plurality of expandable cells 302 (also referred to as "truss structures" in some contexts) that facilitate the expansion of the truss structure 114 from the contracted state (FIG. 3A) to the expanded state (FIG. 3B). In at least one embodiment, for example, the expandable cells 302 of the truss structure 114 may be characterized as bistable or multistable cells, where each bistable or multistable cell has a curved thin strut 304 connected to a curved thick strut 306. The geometry of the bistable/multistable cells is such that the tubular cross-section of the truss structure 114 can be expanded in the radial direction to increase the overall diameter of the truss structure 114. As the truss structure 114 expands radially, the bistable/multistable cells deform elastically until a specific geometry is reached. At this point the bistable/multistable cells move (e.g., snap) to an expanded geometry. In some embodiments, additional force may be applied to stretch the bistable/multistable cells to an even wider expanded geometry. With some materials and/or bistable/multistable cell designs, enough energy can be released in the elastic deformation of the expandable cell 302 (as each bistable/multistable cell snaps past the specific geometry) that the expandable cells 302 are able to initiate the expansion of adjoining bistable/multistable cells past the critical bistable/multistable cell geometry. With other materials and/or bistable/multistable cell designs, the bistable/multistable cells move to an expanded geometry with a nonlinear stair-stepped force-displacement profile.

At least one advantage to using a truss structure 114 that includes bistable/multistable expandable cells 302 is that the axial length of the truss structure 114 in the contracted and expanded configurations will be essentially the same. An expandable bistable/multistable truss structure 114 is thus designed so that as the radial dimension expands, the axial length of the truss structure 114 remains generally constant. Another advantage to using a truss structure 114 that includes bistable/multistable expandable cells 302 is that the expanded cells 302 are stiffer and will create a high collapse strength with less radial movement. Additional discussion regarding bistable/multistable devices and other expandable cells can be found in co-owned U.S. Pat. No. 8,230,913 entitled "Expandable Device for use in a Well Bore," the contents of which are hereby incorporated by reference in their entirety.

Figure 4A:
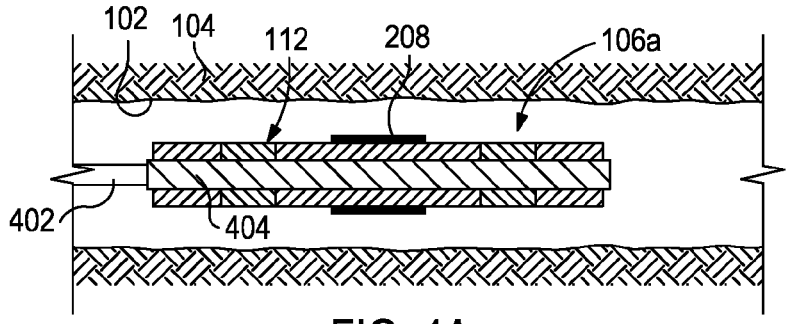
FIGS. 4A-4D illustrate progressive views of an end section of an exemplary downhole completion system being installed in an open hole section of a wellbore, according to one or more embodiments.

Referring now to FIGS. 4A-4D, with continued reference to FIGS. 1, 2A-2B, and 3A-3B, illustrated are progressive views of an end section 106*a* being installed or otherwise deployed within an open hole section 102 of the wellbore 104. While FIGS. 4A-4D depict the deployment or installation of an end section 106*a*, it will be appreciated that the following description could equally apply to the deployment or installation of a middle section 106*b*, without departing from the scope of the disclosure. As illustrated in FIG. 4A, a conveyance device 402 may be operably coupled to the sealing structure 112 and otherwise used to transport the sealing structure 112 in its contracted configuration into the open hole section 102 of the wellbore 104. As briefly noted above, the outer diameter of the sealing structure 112 in its contracted configuration may be small enough to axially traverse the axial length of the production tubing 108 (FIG. 1) without causing obstruction thereto. The conveyance device 402 may extend from the surface of the well and, in some embodiments, may be or otherwise utilize one or more mechanisms such as, but not limited to, wireline cable, coiled tubing, coiled tubing with wireline conductor, drill pipe, tubing, casing, combinations thereof, or the like.

A deployment device 404 may also be incorporated into the sealing structure 112 and transported into the open hole section 102 concurrently with the sealing structure 112 using the conveyance device 402. Specifically, the deployment device 404 may be operably connected or operably connectable to the sealing structure 112 and, in at least one embodiment, may be arranged or otherwise accommodated within the sealing structure 112 when the sealing structure 112 is in its contracted configuration. In other embodiments, the sealing structure 112 and the deployment device 404 may be run into the wellbore 104 separately, without departing from the scope of the disclosure.

The deployment device 404 may be any type of fixed expansion tool such as, but not limited to, an inflatable balloon, a hydraulic setting tool (e.g., an inflatable packer element or the like), a mechanical packer element, an expandable swage, a scissoring mechanism, a wedge, a piston apparatus, a mechanical actuator, an electrical solenoid, a plug type apparatus (e.g., a conically shaped device configured to be pulled or pushed through the sealing structure 112), a ball type apparatus, a rotary type expander, a flexible or variable diameter expansion tool, a small diameter change cone packer, combinations thereof, or the like.

Figure 4B:
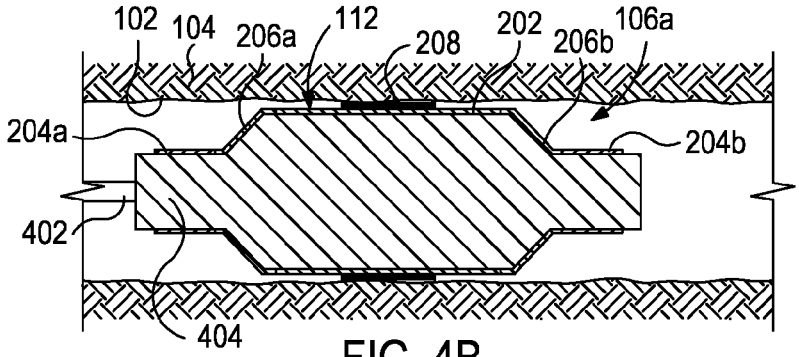

Referring to FIG. 4B, illustrated is the sealing structure 112 as it is expanded using the exemplary deployment device 404, according to one or more embodiments. In some embodiments, as illustrated, the sealing structure 112 is expanded until engaging the inner radial surface of the open hole section 102. The sealing element 208 may or may not be included with the sealing structure 112 in order to create an annular seal between the sealing structure 112 and the inner radial surface of the wellbore 104. As illustrated, the deployment device 404 may serve to deform the sealing structure 112 such that the sealing section 202, the connection sections 204*a,b*, and the transition sections 206*a,b* radially expand and thereby become readily apparent.

In embodiments where the deployment device 404 is a hydraulic setting tool, for example, the deployment device 404 may be inflated or otherwise actuated such that it radially expands the sealing structure 112. In one or more embodiments, the sealing structure 112 may be progressively expanded in discrete sections of controlled length. To accomplish this, the deployment device 404 may include short length expandable or inflatable packers designed to expand finite and predetermined lengths of the sealing structure 112. In other embodiments, the deployment device 404 may be configured to expand radially at a first location along the length of the sealing structure 112, and thereby radially deform or expand the sealing structure 112 at that first location, then deflate and move axially to a second location where the process is repeated. At each progressive location within the sealing structure 112, the deployment device 404 may be configured to expand at multiple radial points about the inner radial surface of the sealing structure 112, thereby reducing the number of movements needed to expand the entire structure 112.

Those skilled in the art will recognize that using short expansion lengths may help to minimize the chance of rupturing the sealing structure 112 during the expansion process. Moreover, expanding the sealing structure 112 in multiple expansion movements may help the sealing structure 112 achieve better radial conformance to the varying diameter of the open hole section 102.

In operation, the sealing structure 112 may serve to seal a portion of the open hole section 102 of the wellbore 104 from the influx of unwanted fluids from the surrounding subterranean formations. As a result, intelligent production operations may be undertaken at predetermined locations along the length of the wellbore 104, as discussed below. The sealing structure 112 may also exhibit structural resistive strength in its expanded form and therefore be used as a structural element within the wellbore 104 configured to help prevent wellbore 104 collapse. In yet other embodiments, the sealing structure 112 may be used as a conduit for the conveyance of fluids therethrough.

Figure 4C:
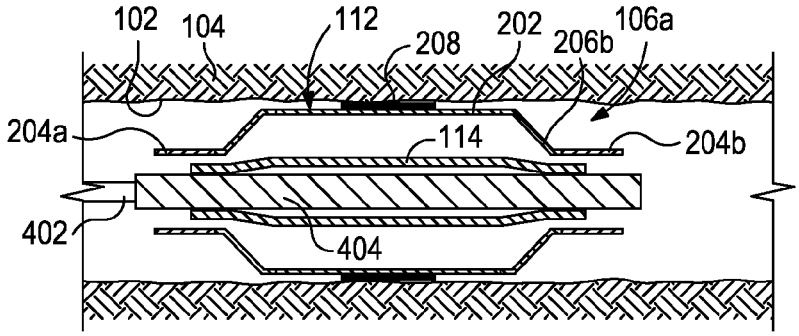

Referring to FIG. 4C, illustrated is the strength or truss structure 114 in its contracted configuration as arranged within or otherwise being extended through the sealing structure 112. As with the sealing structure 112, the truss structure 114 may be conveyed or otherwise transported to the open hole section 102 of the wellbore 104 using the conveyance device 402, and may exhibit a diameter in its contracted configuration that is small enough to axially traverse the production tubing 108 (FIG. 1). In some embodiments, the truss structure 114 may be run in contiguously or otherwise nested within the sealing structure 112 in a single run-in into the wellbore 104. In other embodiments, however, as illustrated herein, the truss structure 114 may be run into the open hole section 102 independently of the sealing structure 112, such as after the deployment of the sealing structure 112, and otherwise during the course of a second run-in into the wellbore 104. This may prove advantageous in embodiments where larger expansion ratios or higher collapse ratings are desired or otherwise required within the wellbore 104. In such embodiments, the downhole completion system 100 may be assembled in multiple run-ins into the wellbore 104, where the sealing structure 112 is installed separately from the truss structure 114.

In order to properly position the truss structure 114 within the sealing structure 112, in at least one embodiment, the truss structure 114 may be configured to land on, for example, one or more profiles (not shown) located or otherwise defined on the sealing structure 112. An exemplary profile may be a mechanical profile on the sealing structure 112 which can mate with the truss structure 114 to create a resistance to movement by the conveyance 402. This resistance to movement can be measured as a force, as a decrease in motion, as an increase in current to the conveyance motor, as a decrease in voltage to the conveyance motor, etc. The profile may also be an electromagnetic profile that is detected by the deployment device 404. The electromagnetic profile may be a magnet or a pattern of magnets, an RFID tag, or an equivalent profile that determines a unique location.

In some embodiments, the profile(s) may be defined at one or more of the connection sections 204*a,b* which may exhibit a known diameter in the expanded configuration. The known expanded diameter of the connection sections 204*a,b*, may prove advantageous in accurately locating an expanded sealing structure 112 or otherwise connecting a sealing structure 112 to a subsequent or preceding sealing structure 112 in the downhole completion system 100. Moreover, having a known diameter at the connection sections 204*a,b* may provide a means whereby an accurate or precise location within the system 100 may be determined.

Figure 4D:
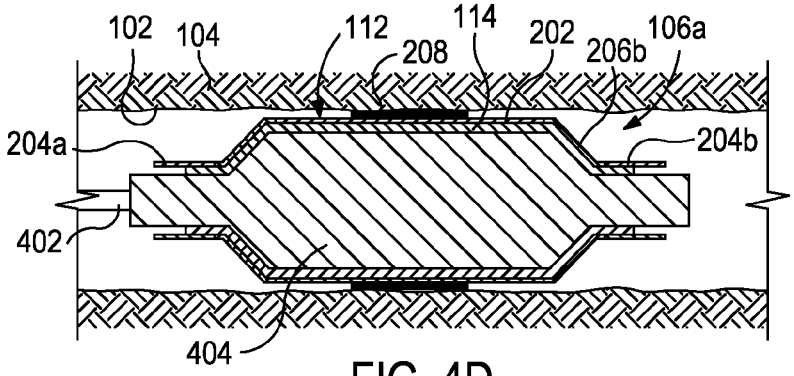

Referring to FIG. 4D, illustrated is the truss structure 114 as being expanded within the sealing structure 112. Similar to the sealing structure 112, the truss structure 114 may be forced into its expanded configuration using the deployment device 404. In at least one embodiment, the deployment device 404 is an inflatable packer element. As the deployment device 404 expands, it forces the truss structure 114 to also expand radially. In embodiments where the truss structure 114 includes bistable/multistable expandable cells 302 (FIG. 3B), at a certain expansion diameter the bistable/multistable expandable cells 302 reach a critical geometry where the bistable/multistable "snap" effect is initiated, and the truss structure 114 expands autonomously. Similar to the expansion of the sealing structure 112, the deployment device 404 may be configured to expand the truss structure 114 at multiple discrete locations. For instance, the deployment device 404 may be configured to expand radially at a first location along the length of the truss structure 114, then deflate and move axially to a second, third, fourth, etc., location where the process is repeated.

In operation, the truss structure 114 in its expanded configuration supports the sealing structure 112 against collapse. In cases where the sealing structure 112 engages the inner radial surface of the wellbore 104, the truss structure 114 may also provides collapse resistance against the wellbore 104 in the open hole section 102. In other embodiments, especially in embodiments where the truss structure 114 employs bistable/multistable expandable cells 302 (FIG. 3B), the truss structure 114 may further be configured to help the sealing structure 112 expand to its fully deployed or expanded configuration. For instance, the "snap" effect of the bistable/multistable expandable cells 302 may exhibit enough expansive force that the material of the sealing structure 112 is forced radially outward in response thereto.

Figure 5:
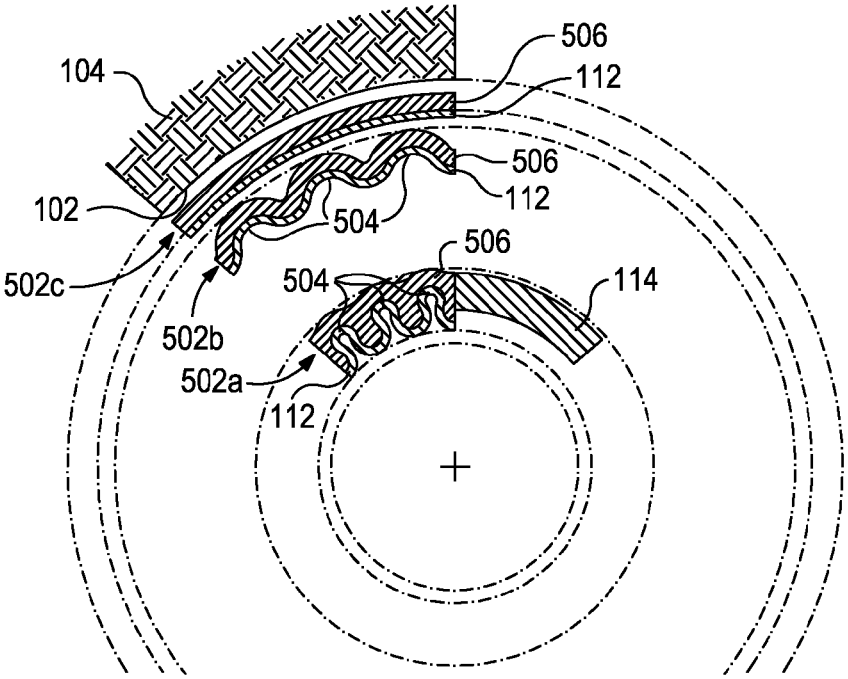
FIG. 5 illustrates a partial cross-sectional view of a sealing structure in its compressed, intermediate, and expanded configurations, according to one or more embodiments.

Referring now to FIG. 5, with continued reference to FIGS. 1, 2A-2B, and 4A-4B, illustrated is a cross-sectional end view of an exemplary sealing structure 112 in progressive expanded forms, according to one or more embodiments. Specifically, the depicted sealing structure 112 is illustrated in a first unexpanded state 502*a*, a second expanded state 502*b*, and a third expanded state 502*c*, where the second expanded state 502*b* exhibits a larger diameter than the first unexpanded state 502*a*, and the third expanded state 502*c* exhibits a larger diameter than the second expanded state 502*b*. It will be appreciated that the illustrated sealing structure 112 may be representative of a sealing structure 112 that forms part of either an end section 106*a* or a middle section 106*b*, as described above with reference to FIG. 1, and without departing from the scope of the disclosure.

As illustrated, the sealing structure 112 may be made of a corrugated material, such as metal (or another pliable or expandable material), thereby defining a plurality of contiguous, expandable folds 504 (i.e., corrugations). Those skilled in the art will readily appreciate that corrugated tubing may simplify the expansion process of the sealing structure 112, extend the ratio of potential expansion diameter change, reduce the energy required to expand the sealing structure 112, and also allow for an increased final wall thickness as compared with related prior art applications. Moreover, as illustrated, the sealing structure 112 may have a sealing element 506 disposed about its outer radial surface. The sealing element 506 may be similar to the sealing element 208 of FIGS. 2A-2B, and therefore will not be described again in detail.

In the first unexpanded state 502*a*, the sealing structure 112 is in its compressed configuration and able to be run into the open hole section 102 of the wellbore 104 via the production tubing 108 (FIG. 1). The folds 504 allow the sealing structure 112 to be compacted into the contracted configuration, but also allow the sealing structure 112 to expand as the folds flatten out during expansion. For reference, the strength or truss structure 114 is also shown in the first unexpanded state 502*a*. As described above, the truss structure 114 may also be able to be run into the open hole section 102 through the existing production tubing 108 and therefore is shown in FIG. 5 as having essentially the same diameter as the sealing structure 112 in their respective contracted configurations. In embodiments where the truss structure 114 is run into the wellbore 104 simultaneously with the sealing structure 112, the diameter of the truss structure 114 in its contracted configuration would be smaller than as illustrated in FIG. 5. In such embodiments, the truss structure 114 would exhibit a diameter in its contracted configuration small enough to be accommodated within the interior of the sealing structure 112.

In the second expanded state 502*b*, the sealing structure 112 may be expanded to an intermediate diameter (e.g., a diameter somewhere between the contracted and fully expanded configurations). As illustrated, in the second expanded state 502*b*, various peaks and valleys may remain in the folds 504 of the sealing structure 112, but the amplitude of the folds 504 is dramatically decreased as the material is gradually flattened out in the radial direction. In one or more embodiments, the intermediate diameter may be a predetermined diameter offset from the inner radial surface of the open hole section 102 or a diameter where the sealing structure 112 engages a portion of the inner radial surface of the open hole section 102.

Where the sealing structure 112 engages the inner radial surface of the open hole section 102, the sealing element 506 may be configured to seal against said surface, thereby preventing fluid communication either uphole or downhole with respect to the sealing structure 112. In some embodiments, the sealing element 506 may be swellable or otherwise configured to expand in order to seal across a range of varying diameters in the inner radial surface of the open hole section 102. Such swelling expansion may account for abnormalities in the wellbore 104 such as, but not limited to, collapse, creep, washout, combinations thereof, and the like. As the sealing element 506 swells or otherwise expands, the valleys of the sealing structure 112 in the second expanded state 502*b* may be filled in.

In the third expanded state 502*c*, the sealing structure 112 may be expanded to its fully expanded configuration or diameter. In the fully expanded configuration the peaks and valleys of the folds 504 may be substantially reduced or eliminated altogether. Moreover, in the expanded configuration, the sealing structure 112 may be configured to engage or otherwise come in close contact with the inner radial surface of the open hole section 102. As briefly discussed above, in some embodiments, the sealing element 506 may be omitted and the sealing structure 112 itself may instead be configured to sealingly engage the inner radial surface of the open hole section 102.

Referring now to FIGS. 6A-6D, with continued reference to FIGS. 1 and 4A-4D, illustrated are progressive views of building or otherwise extending the axial length of a downhole completion system 600 within an open hole section 102 of the wellbore 104, according to one or more embodiments of the disclosure. As illustrated, the system 600 includes a first section 602 that has already been successively installed within the wellbore 104. The first section 602 may correspond to an end section 106*a* (FIG. 1) and, in at least one embodiment, its installation may be representative of the description provided above with respect to FIGS. 4A-4D. In particular, the first section 602 may be complete with an expanded sealing structure 112 and at least one expanded strength or truss structure 114 arranged within the expanded sealing structure 112. Those skilled in the art, however, will readily appreciate that the first section 602 may equally be representative of an expanded or installed middle section 106*b* (FIG. 1), without departing from the scope of the disclosure.

The downhole completion system 600 may be extended within the wellbore 104 by running one or more continuation or second sections 604 into the open hole section 102 and coupling the second section 604 to the distal end of an already expanded preceding section, such as the first section 602 (e.g., either an end or middle section 106*a,b*). While the second section 604 is depicted in FIGS. 6A-6D as representative of a middle section 106*b* (FIG. 1), those skilled in the art will again readily appreciate that the second section 604 may equally be representative of an end section 106*a* (FIG. 1), without departing from the scope of the disclosure.

As illustrated, the conveyance device 402 may again be used to convey or otherwise transport the sealing structure 112 of the second section 604 downhole and into the open hole section 102. The diameter of the sealing structure 112 in its contracted configuration may be small enough to pass through not only the existing production tubing 108 (FIG. 1), but the expanded first section 602. The sealing structure 112 of the second section 604 is run into the wellbore 104 in conjunction with the deployment device 404 which may be used to radially expand the sealing structure 112 upon actuation.

In one or more embodiments, the sealing structure 112 of the second section 604 may be run through the first section 602 such that the proximal connection section 204*a* of the second section 604 axially overlaps the distal connection section 204*b* of the first section 602 by a short distance. In other embodiments, however, the adjacent sections 602, 604 do not necessarily axially overlap at the adjacent connection sections 204*a,b* but may be arranged in an axially-abutting relationship or even offset a short distance from each other, without departing from the scope of the disclosure.

Figure 6A:
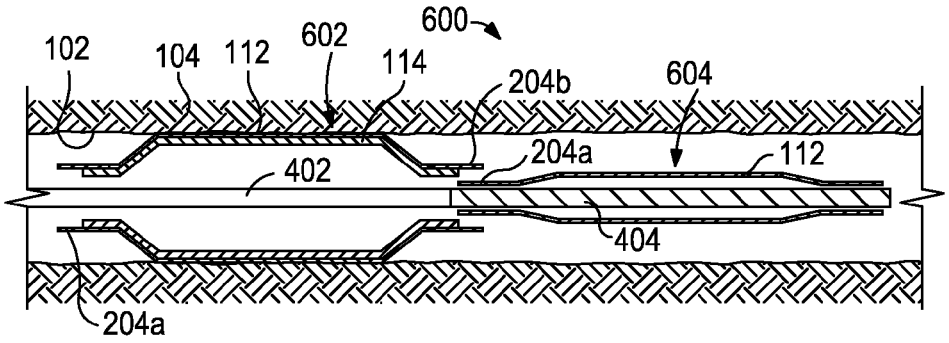
FIGS. 6A-6D illustrate progressive views of building an exemplary downhole completion system within an open hole section of a wellbore, according to one or more embodiments.
Figure 6B:
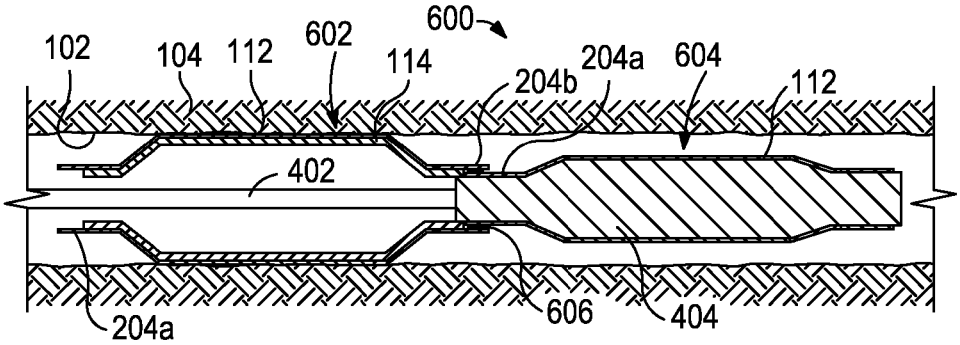

Referring to FIG. 6B, illustrated is the expansion of the sealing structure 112 of the second section 604 using the deployment device 404. In some embodiments, the sealing structure 112 of the second section 604 may be expanded to contact the inner radial surface of the open hole section 102 and potentially form a seal therebetween. In other embodiments, such as is illustrated, the sealing structure 112 is expanded to a smaller diameter.

As the sealing structure 112 of the second section 604 expands, its proximal connection section 204*a* expands radially such that its outer radial surface engages the inner radial surface of the distal connection section 204*b* of the first section 602, thereby forming a mechanical seal therebetween. In other embodiments, a sealing element 606 may be disposed about one or both of the outer radial surface of the proximal connection section 204*a* or the inner radial surface of the distal connection section 204*b*. The sealing element 606, which may be similar to the sealing element 208 described above (i.e., rubber, elastomer, swellable, non-swellable, etc.), may help form a fluid-tight seal between adjacent sections 602, 604. In some embodiments, the sealing element 606 serves as a type of glue between adjacent sections 602, 604 configured to increase the axial strength of the system 600.

Figure 6C:
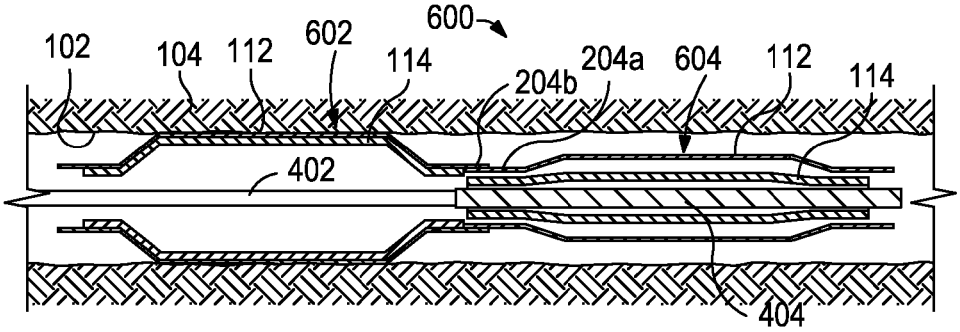

Referring to FIG. 6C, illustrated is a strength or truss structure 114 in its contracted configuration being run into the wellbore 104 and the expanded sealing structure 112 of the second section 604 using the conveyance device 402. In its contracted configuration, the truss structure 114 exhibits a diameter small enough to traverse both the production tubing 108 (FIG. 1) and the preceding first section 602 without causing obstruction.

Figure 6D:
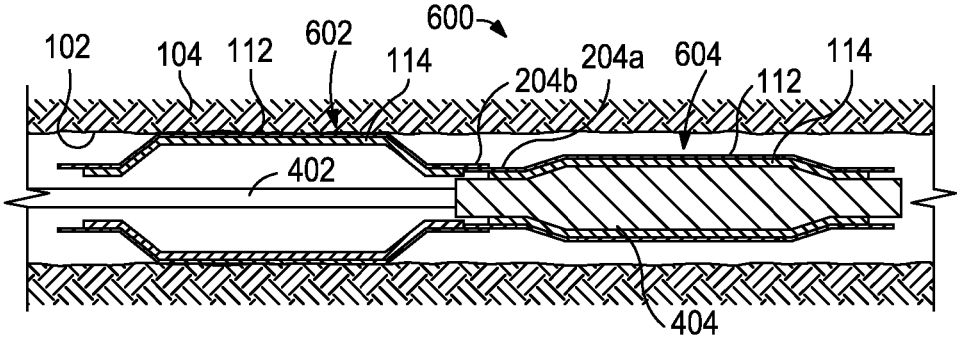

Referring to FIG. 6D, illustrated is the truss structure 114 as being expanded within the sealing structure 112 using the deployment device 404. In its expanded configuration, the truss structure 114 provides radial support to the sealing structure 112 and may help prevent wellbore 104 collapse in the open hole section 102, where applicable.

Figure 7:
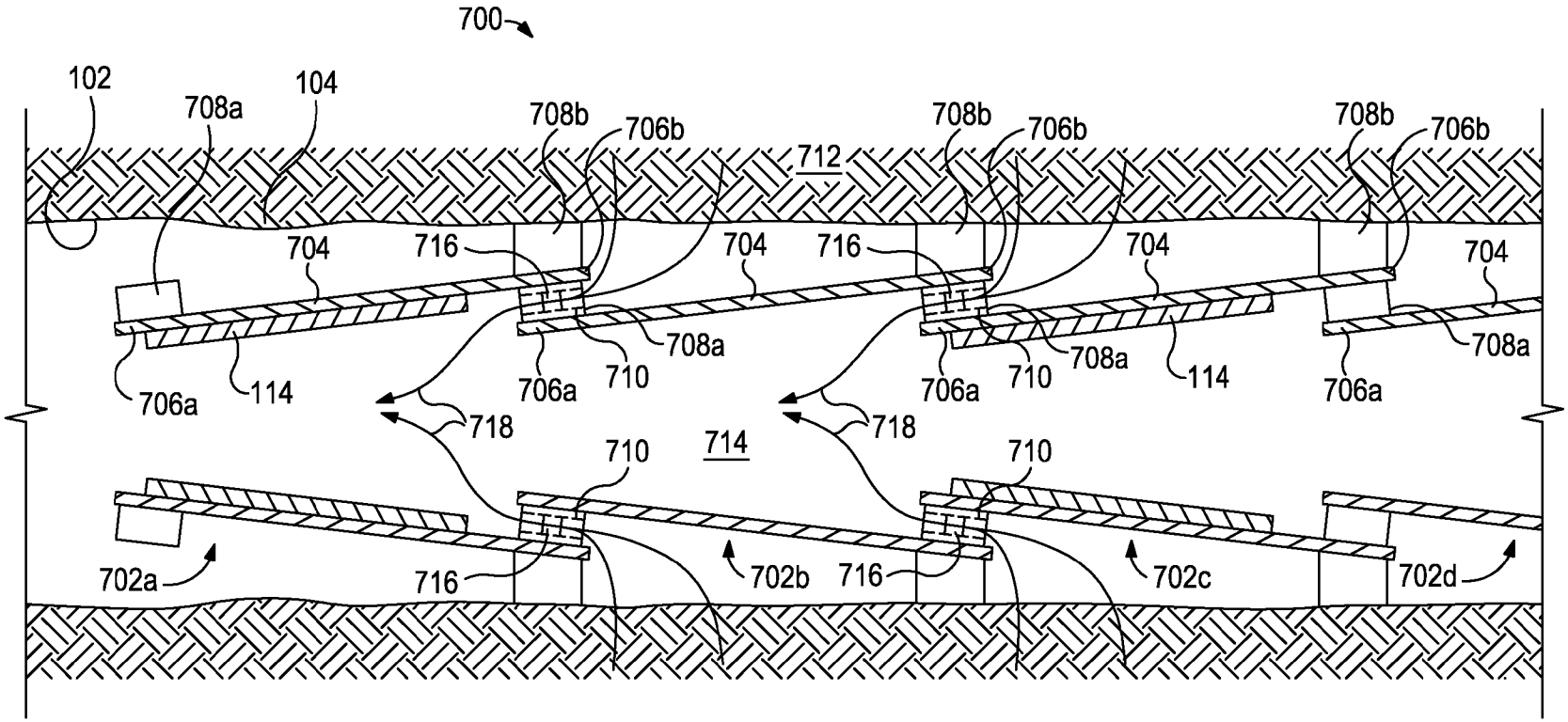
FIG. 7 illustrates a cross-sectional view of a portion of another exemplary downhole completion system, according to one or more embodiments.

Referring now to FIG. 7, illustrated is a cross-sectional view of a portion of another exemplary downhole completion system 700, according to one or more embodiments. The downhole completion system 700 may be similar in some respects to the downhole completion systems 100 and 600 of FIG. 1 and FIGS. 6A-6D, respectively, and therefore may be best understood with reference thereto. The system 700 may include a plurality of sections 702, shown as a first section 702*a*, a second section 702*b*, a third section 702*c*, and a fourth section 702*d* (partial). As illustrated, the sections 702*a-d* may be successively installed in the axial direction within the open hole section 102 of the wellbore 104. Those skilled in the art, however, will readily recognize that the downhole completion system 700 may equally be installed in a cased section of a wellbore, such as being used as a casing patch, or the like, without departing from the scope of the disclosure.

Each section 702*a-d* may include a sealing structure 704 similar in some respects to the sealing structure 112 of FIGS. 2A and 2B. For instance, the sealing structure 704 may be an elongate, corrugated tubular having a plurality of longitudinally-extending corrugations or folds (not shown) defined therein, as generally described above with reference to FIG. 5. As the sealing structure 704 expands, the corrugations or folds are gradually unfolded. Moreover, the sealing structures 704 may be made of metal, metal alloys, thermoset plastics, thermoplastics, fiber reinforced composites, cementitious composites, combinations thereof, or the like.

However, unlike the sealing structure 112 of FIGS. 2A and 2B, the sealing structures 704 depicted in FIG. 7 may be configured to expand to an expanded configuration wherein the body of the sealing structure 704 has a generally frustoconical shape, or otherwise has the general shape of a frustum, with opposing ends. As a result, the sealing structures 704 may be stacked together on the deployment device 404 (FIGS. 4A-4D) and run into the wellbore 104 together and each sealing structure 704 may be at least partially nested within an axially preceding sealing structure 704 upon deployment in the open hole section 102. In some embodiments, the frustoconical shape of each sealing structure 704 may be made possible from the wavelength of the longitudinal corrugations along the axial length of the sealing section 704 which may progressively become larger from one end of the sealing structure 704 to the other.

For instance, the sealing structure 704 may initially be manufactured to its final expanded shape or configuration and then subsequently compacted into the contracted configuration. In the process of compacting the sealing structure 704, the corrugations may be defined along its axial length. The shape and depth of the resulting corrugations can create the differences in the compressed condition so that the sealing structure 704 may be partially nested within an adjacent sealing structure 704 for running into the well. As will be appreciated, nesting of the sealing structures 704 within the well can be achieved with no special shaping other than that needed to compress the diameter for passing through the restrictive diameters.

In other embodiments, however, the deployment device 404 may be configured to strategically expand the sealing structure 704 such that a frustoconically-shaped sealing structure 704 results. For instance, the expansion process may plastically deform one end of the sealing structure more dramatically than the other end in order to create the tapered or stepped diameter along the axial length of the particular sealing structure 704. The generally frustoconical shape of the sealing structure 704 can further be achieved using a tubular exhibiting a progressively increasing diameter along its axial length, or tubulars of progressively increasing diameters nested in an axially stacked arrangement.

In one or more embodiments, a strength or truss structure 114 may be arranged or otherwise expanded within one or more of the sealing structures 704 in order to provide an amount of radial support. As illustrated, a corresponding truss structure 114 is depicted as being disposed within the first section 702*a* and the third section 702*c*. In other embodiments, more than one truss structure 114 may be arranged within a single section 702*a-d*. In yet other embodiments, a single truss structure 114 may overlap two or more sections 702*a-d*, without departing from the scope of the disclosure. For instance, the axial length of a sealing structure 704 may range between 4 feet and 6 feet or more, and a single truss structure 114 may be designed to extend across multiple sealing structures 704.

Similar to the connection sections 204*a* and 204*b* of FIGS. 2A and 2B, each sealing structure 704 may further include opposing connection sections 706*a* and 706*b* defined at either end of the sealing structure 704. As illustrated, one or more of the sealing structures 704 may include a sealing element 708 (shown as sealing elements 708*a* and 708*b*) arranged at one or both of the first and second connection sections 706*a,b*. In some embodiments, for instance, a first sealing element 708*a* may be arranged about the outer radial surface of each sealing structure 704 at the first connection section 706*a*, and a second sealing element 708*b* may be arranged about the outer radial surface of each sealing structure 704 at the second connection section 706*b*. In other embodiments, however, each sealing element 708*a,b* may be arranged at or adjacent the second connection section 706*b*, with the first sealing element 708*a* being arranged about the inner radial surface of the sealing structure 704 and the second sealing element 708*b* being arranged about the outer radial surface of the sealing structure 704. In yet other embodiments, one of the sealing elements 708*a,b* may be omitted from a particular sealing structure 704, without departing from the scope of the disclosure.

One or both of the sealing elements 708*a,b* may be made of an elastomer or a rubber, and may be swellable or non-swellable, depending on the application. In at least one embodiment, one or both of the sealing elements 708*a,b* may be a swellable elastomer made from a mixture of a water swell elastomer and an oil swell elastomer. Each sealing element 708*a,b* may be configured to expand as its corresponding sealing structure 704 is deployed in the wellbore 104. In some embodiments, an additional layer of protective material (not shown) may surround the outer radial circumference of each sealing element 708*a,b* to protect the sealing elements 708*a,b* as they are advanced through the production tubing 108 (FIG. 1).

In operation, the first sealing element 708*a* may be configured to help form a fluid-tight seal between adjacent sections 702*a-d* as the sections 702*a-d* are expanded or otherwise deployed within the wellbore 104. Specifically, the first sealing element 708*a* of each sealing structure 704 may be configured to sealingly engage axially adjacent sealing structures 704 such that the two succeeding sections 702*a-d* providing a fluid-tight conduit within the wellbore 102.

In some embodiments, the first sealing element 708*a* may serve as a type of glue or coupling mechanism for axially adjacent sections 702*a-d* which increases the axial strength of the system 700. The second sealing element 708*b*, however, may be configured to engage and seal against the inner diameter of the open hole section 102, thereby providing multiple sealed intervals along the wellbore 104.

In some embodiments, some of the first sealing elements 708*a* may define one or more conduits 710 (shown in dashed within sealing elements 708*a* of sections 702*b* and 702*c*) therein configured to provide fluid communication between a surrounding subterranean formation 712 and the interior 714 of the system 700. In at least one embodiment, one or more flow control devices 716 may be arranged within each conduit 710 and may be configured to regulate a fluid flow 718 therethrough. Accordingly, the flow control devices 116 may provide a planned flow path for fluids to communicate between the subterranean formation 712 and the interior 714 of the system 700.

The flow control device 716 may be an expandable or flexible device and, in some embodiments, may be, but is not limited to, an inflow control device, an autonomous inflow control device, a valve (e.g., expandable, expansion, etc.), a sleeve, a sleeve valve, a sliding sleeve, a filter (e.g., a sand filter), a flow restrictor, a check valve (operable in either direction, in series or in parallel with other check valves, etc.), combinations thereof, or the like.

In exemplary operation, the flow control devices 716 may provide the option of preventing or otherwise restricting fluid flow 718 into the interior 714 of the system 700 at that particular point. Alternatively, the flow control devices 716 may be configured to regulate fluid flow 718 out of the interior 714 of the system 700, such as in an injection operation. Accordingly, production and/or injection operations can be intelligently controlled via the flow control devices 716. In some embodiments, production/injection operations may be controlled by flow rate or pressure loss, or both. In other embodiments, the production/injection operations may be restricted by several parameters of the fluid flow 718 such as, but not limited to, the flow rate, fluid density, viscosity, conductivity, or any combination of these.

In some embodiments, a filter device or filter material (not shown) may be used in conjunction with the one or more conduits 710 and/or flow control devices 716. For instance, an exemplary filter device may be arranged about the sealing structure 704 or otherwise arranged so as to substantially occlude the flow path through the conduits 710, thereby restricting or stopping movement of particulate matter, such as particulates of a defined size or larger, from passing through the conduits 710. In one embodiment, the filter device may be a woven mesh structure made from, for example, cloth, linens, wire, other metal strands, combinations thereof, or the like. In other embodiments, the filter device may be a packed structure including sized particles such as, but not limited to, gravel, beads, balls, combinations thereof, and the like. In yet other embodiments, the filter device may be an expandable wire wrap structure, such as a sand screen or the like. In even further embodiments, the filter device may be a combination of one or more of the above types of filter devices, and otherwise may include multiple layers of such structures.

The filter device may be configured such that it is able to be folded or otherwise compressed to a smaller diameter, such that it may be radially small enough to axially traverse the production tubing 108 (FIG. 1). Moreover, the filter device may be radially expandable along with the associated sealing structure 704 once reaching the predetermined location for deployment within the wellbore 104. Consequently, the materials used to manufacture the filter device may provide flexibility to the filter device for expansion and/or deployment within the wellbore 104, and may also be designed to resist compaction from contact stress with the formation 712. The filter materials may also exhibit satisfactory temperature, fluid, and chemical resistance for the intended well and fluids encountered therein.

In some embodiments, the controls, instructions, or relative configuration of each flow control device 716 (e.g., valve position between open and closed positions) may be changed by wire line intervention, or other standard oilfield practices, as well as by intervention-less methods known to those skilled in the oil field completion technology. In other embodiments, however, one or more of the flow control devices 716 may be remotely controlled by an operator via wired or wireless communication techniques known to those skilled in the art, such as via wireless telemetry or other electrically-powered devices. In some embodiments, the operator may remotely control the flow control device 704 from a remote geographic location away from the site of the downhole completion system 700 using wired, wireless, or satellite telecommunications.

The system 700 may further employ battery-powered or flow-powered devices (not shown) for telemetry, monitoring, and/or control of the flow control devices 716. A computer (not shown) having a processor and a computer-readable medium may be communicably coupled to each flow control device 716 and configured to autonomously operate or actuate the flow control devices 716 in response to a signal perceived from the battery-powered or flow-powered devices. As will be appreciated by those skilled in the art, suitable actuators or solenoids (not shown) may be used to manipulate the flow rate of the flow control devices 716 as directed by the computer or processor.

Those skilled in the art will readily appreciate the several advantages the disclosed systems and methods may provide. For example, the disclosed downhole completion systems are able to be run through existing production tubing 108 (FIG. 1) and then assembled in an open hole section 102 of the wellbore 104. Accordingly, the production tubing 108 is not required to be pulled out of the wellbore 104 prior to installing the downhole completion systems, thereby saving a significant amount of time and expense. Another advantage is that the downhole completion systems can be run and installed without the use of a rig at the surface. Rather, the downhole completion systems may be extended into the open hole section 102 entirely on wireline, slickline, coiled tubing, or jointed pipe. Moreover, it will be appreciated that the downhole completion systems may be progressively built either toward or away from the surface within the wellbore 104, without departing from the scope of the disclosure. Even further, the final inner size of the expanded sealing structures 112 and truss structures 114 may allow for the conveyance of additional lengths of standard diameter production tubing through said structures to more distal locations in the wellbore.

Advantages of the system 700 of FIG. 7 include the ability to mass produce short, transportable, affordable, and customizable, sealing components in the form of the frustoconical sealing structure 704. Not only does the frustoconical shape of each sealing structure 704 generate the deployed running length for run-in-hole operations, but it may also reduce manufacturing costs and complexity. The flexibility of the frustoconical shape allows the system 700 to adapt to the varying well conditions, such as the wellbore 104 inner diameter, the potential flow controls, anticipated pressures, length, and other conditions. Moreover, the combined structure of the stacked sealing structures 704 in the axial direction may provide increased collapse resistance and increased wellbore 104 compliance.

Another advantage of the system 700 is the multiple seals that are created against the open hole section 102 of the wellbore 104 with the several second sealing elements 708*b*. As a result, several micro-zones are defined within each larger production zone of the open hole section 102. Isolating such micro-zones within the wellbore 104 may provide several advantages. For instance, having multiple open hole formation seals 708*b* with designed lengths provides better sealing efficiency, higher pressure control, lower bypass around or past the seals 708*b*, lower annular transportation of solids (or elimination thereof), better sealing dynamics with the formation 712 porosity due to the multiple seals 708*b*, and independent sealing at multiple locations. Moreover, the designed length can be configured to match elastomeric properties to sealing requirements. This can provide the operator with a swell percentage to sealing shear requirements, the flexibility to reduce swelling percentage, increased formation 712 contact pressure, the potential for stacked sealing designs that increase reach while increasing pressure rating, increased controlling of the shear loading in the sealing material, and an increase in the lateral location grip. Also, isolating these shorter sections may prove advantageous in providing the opportunity to increase mechanical grip against the formation 716 to withstand thermal loading and/or axial pressure loading of the system.

Such isolated micro-zones may also allow for better inflow control performance and particle migration control. For instance, advantages are obtained in the intelligent production and injection capabilities afforded by the disclosed flow control devices 716 associated with one or more of the first sealing elements 708*a*. The flow control devices 716 may provide a planned flow path for fluids to communicate between the surrounding subterranean formation 712 and the interior 714 of the downhole completion system 700. Such flow control devices 716 may be manually or autonomously operated in order to optimize hydrocarbon production.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patents or other documents that may be incorporated herein by reference, the definitions that are consistent with this specification should be adopted.

The invention claimed is:

1. A downhole completion system, comprising:

a first sealing structure having opposing first and second ends, the first sealing structure being movable between a contracted configuration and an expanded configuration; and a second sealing structure having opposing first and second ends and being arranged proximate the first sealing structure, the second sealing structure also being movable between a contracted configuration and an expanded configuration, wherein, when the first and second sealing structures are in the expanded configuration, each exhibits a frustoconical shape extending between the opposing first and second ends of the first and second sealing structures, and the first end of the second sealing structure is at least partially nested within the second end of the first sealing structure.

2. The system of claim 1, further comprising a sealing element arranged about an outer radial surface of the second end of one or both of the first and second sealing structures, the sealing element being configured to sealingly engage a section of a wellbore.

3. The system of claim 1, further comprising:

a first sealing element arranged about an outer radial surface of the second end of the first sealing structure, the first sealing element being configured to sealingly engage a section of a wellbore; and a second sealing element arranged about an inner radial surface of the second end of the first sealing structure, the second sealing element being configured to form a fluid-tight seal between the first and second sealing sections.

4. The system of claim 1, further comprising a sealing element arranged about an outer radial surface of the first end of the second sealing structure, the sealing element being configured to radially interpose the first end of the second sealing structure and the second end of the first sealing structure.

5. The system of claim 4, wherein the sealing element defines one or more conduits configured to provide fluid communication between a surrounding subterranean formation and an interior of the first and second sealing structures.

6. The system of claim 5, further comprising at least one flow control device arranged within the one or more conduits and configured to regulate a fluid flow through the one or more conduits.

7. The system of claim 6, wherein the at least one flow control device comprises a flow control device selected from the group consisting of an inflow control device, an autonomous inflow control device, a valve, a sleeve, a sleeve valve, a sliding sleeve, a filter, a flow restrictor, a check valve, and any combination thereof.

8. The system of claim 1, further comprising a strength structure arranged at least partially within one or both of the first and second sealing structures and also movable between a contracted configuration and an expanded configuration.

9. The system of claim 8, wherein, when in the expanded configuration, the strength structure radially supports at least a portion of the first sealing structure.

10. The system of claim 8, wherein the strength structure is an expandable device that defines a plurality of expandable cells that facilitate expansion of the strength structure from the contracted state to the expanded state.

11. The system of claim 10, wherein the plurality of expandable cells are composed of truss structures, at least some of the truss structures comprising a thin strut connected to a thick strut, and wherein an axial length of the strength structure in the contracted and expanded configurations is the same.

12. A method of completing an open hole section of a wellbore, comprising:

conveying a first sealing structure having opposing first and second ends to the open hole section and radially expanding the first sealing structure to a frustoconical shape extending between the opposing first and second ends of the first sealing structure; and conveying a second sealing structure having opposing first and second ends to the open hole section and radially expanding the second sealing structure to a frustoconical shape extending between the opposing first and second ends of the second sealing structure, wherein, when expanded, the first end of the second sealing structure is at least partially nested within the second end of the first sealing structure.

13. The method of claim 12, further comprising sealingly engaging the open hole section of the wellbore with a sealing element arranged about an outer radial surface of the second end of one or both of the first and second sealing structures.

14. The method of claim 12, further comprising:

sealingly engaging the open hole section of the wellbore with a first sealing element arranged about an outer radial surface of the second end of the first sealing structure; and forming a seal between the first and second sealing sections with a second sealing element arranged about an inner radial surface of the second end of the first sealing structure.

15. The method of claim 12, further comprising sealing an engagement between the first and second sealing sections with a sealing element arranged about an outer radial surface of the first end of the second sealing structure.

16. The method of claim 15, further comprising providing a flow path for fluids to communicate between a surrounding subterranean formation and an interior of the first and second sealing structures, the flow path comprising one or more conduits defined in the sealing element.

17. The method of claim 16, further comprising regulating a fluid flow through the one or more conduits with at least one flow control device arranged within the one or more conduits.

18. The method of claim 12, further comprising:

conveying a strength structure to the open hole section of the wellbore;

radially expanding the strength structure into an expanded configuration while arranged at least partially within the first or second sealing structures; and radially supporting at least a portion of the first and/or second sealing structures with the strength structure.

19. The method of claim 18, further comprising conveying the first and second sealing structures and the strength structure in respective contracted configurations through production tubing arranged within the wellbore.

20. The method of claim 18, wherein radially expanding the strength structure into the expanded configuration further comprises expanding a plurality of expandable cells defined on the strength structure.

21. The method of claim 20, wherein expanding the plurality of expandable cells further comprises radially expanding the strength structure such that an axial length of the strength structure in the contracted and expanded configurations is the same.

* * * * *